US005865345A

United States Patent [19]

Cistone et al.

[11] Patent Number: 5,865,345

[45] Date of Patent: Feb. 2, 1999

[54] CONTAINER FOR DISPENSING TWO SUBSTANCES

[75] Inventors: David R. Cistone, Sea Isle; Douglas Lynch, Mount Laurel, both of N.J.

[73] Assignee: Lawson Mardon Wheaton Inc., Millville, N.J.

[21] Appl. No.: 775,668

[22] Filed: Dec. 31, 1996

[51] Int. Cl.[6] ..... B65D 35/22

[52] U.S. Cl. ..... 222/94; 222/107

[58] Field of Search ..... 222/94, 107; 53/469

[56] References Cited

U.S. PATENT DOCUMENTS

| | | | |
|---|---|---|---|
| 1,894,115 | 1/1933 | Murphy . | |
| 2,661,870 | 9/1948 | Huenergardt . | |
| 3,197,071 | 12/1962 | Kuster . | |
| 3,239,105 | 8/1964 | Woodson . | |
| 3,506,157 | 4/1970 | Dukess . | |
| 3,581,940 | 6/1971 | Cella . | |
| 3,866,800 | 2/1975 | Schmitt . | |
| 3,936,334 | 2/1976 | Kushida et al. | 222/94 X |
| 4,528,180 | 7/1985 | Schaeffer . | |
| 4,753,536 | 6/1988 | Spehar et al. . | |
| 4,964,539 | 10/1990 | Mueller . | |
| 4,974,756 | 12/1990 | Pearson et al. . | |
| 4,979,646 | 12/1990 | Andris . | |
| 4,990,327 | 2/1991 | Neirinckx . | |
| 5,035,349 | 7/1991 | Donahue . | |
| 5,038,963 | 8/1991 | Pettengill et al. . | |
| 5,052,590 | 10/1991 | Ratcliff . | |
| 5,076,464 | 12/1991 | Simon . | |
| 5,076,470 | 12/1991 | Hatakeyama et al. . | |
| 5,102,013 | 4/1992 | Schneider et al. . | |
| 5,102,016 | 4/1992 | Ball et al. . | |
| 5,615,803 | 4/1997 | Hatakeyama et al. | 222/94 |
| 5,714,023 | 2/1998 | Redfern | 53/469 X |

*Primary Examiner*—Gregory L. Huson
*Attorney, Agent, or Firm*—Ratner & Prestia

[57] ABSTRACT

A container, for dispensing two substances simultaneously, that includes a neck portion having two orifices therein, a shoulder portion connected to the neck portion, and an elongated body portion connected to the shoulder portion, the body portion including two adjacent chambers sharing a common wall wherein each chamber is in fluid communication with an orifice in the neck portion, and wherein the two chambers are formed from different materials. The size and shape of the orifices can be varied to independently adjust the rate of dispensation of each of the two substances, or to compensate for variances in viscosity between the substances. The sizes of the two chambers can be varied independently from one another. Further, the two chambers can extend beyond the width of the common wall, to promote even and predictable deformation of the chambers when pressure is applied.

20 Claims, 2 Drawing Sheets

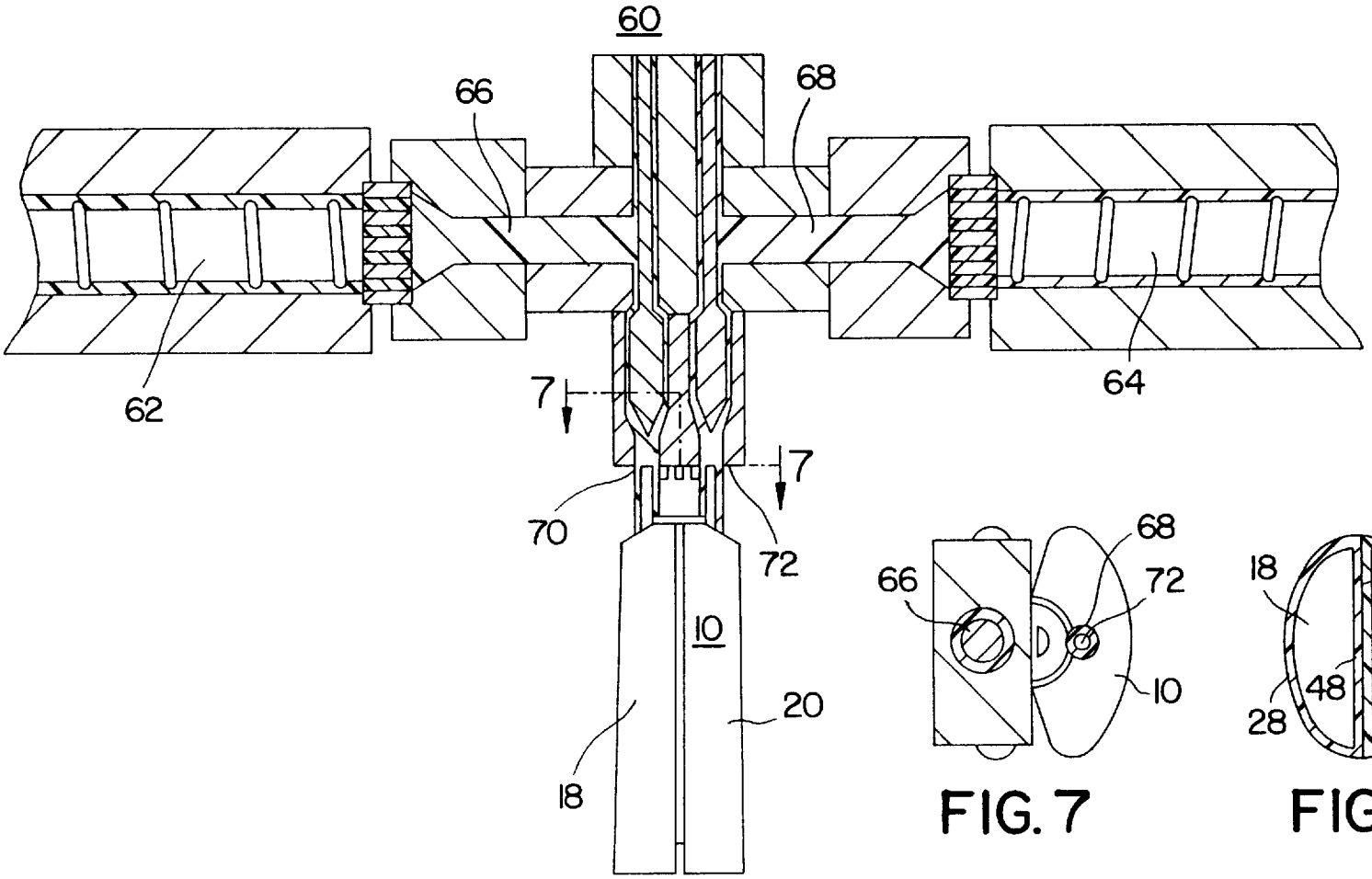
FIG. 6
FIG. 7
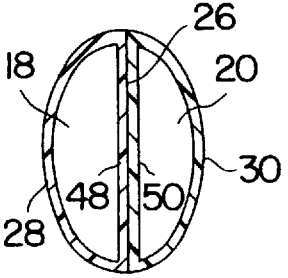
FIG. 8

CONTAINER FOR DISPENSING TWO SUBSTANCES

BACKGROUND OF THE INVENTION

This invention relates to a tube for dispensing two products simultaneously, and more specifically to a tube having two chambers formed from different materials.

A known means for dispensing two products simultaneously involves the use of dual chambers in a dispensing tube. As a typical example, U.S. Pat. No. 4,528,180 to Schaeffer discloses a tube with two chambers, each chamber containing one of the substances to be dispensed. As shown in FIG. 3A of that patent, each chamber is in communication with an orifice through which the substances are dispensed. The two chambers are separated by a divider in the middle of the tube, which is attached to the outside walls of the tube. Upon squeezing the tube, the walls of the tube collapse, creating a pressure within each of the chambers and thereby causing the substances housed in the chambers to be dispensed simultaneously. Alternatively, as shown in FIGS. 1 and 2 of that patent, two separate tubes may be secured together to dispense two substances.

U.S. Pat. No. 4,964,539 to Meuller discloses a tube with a plurality of chambers for dispensing two or more substances simultaneously. As in the Schaeffer patent, the chambers are separated by dividers that attach to the outside walls of the tube. Upon squeezing the tube, the flexible walls create a pressure within the chambers, simultaneously dispensing the substances in the chambers through orifices in communication with the chambers.

U.S. Pat. No. 3,866,800 to Schmitt discloses a non-pressurized package for dispensing two products. The package has bellowed chambers for allowing more uniform dispensing of product.

Other such dispensing tubes are known wherein the tube contains two or more chambers, each housing a substance to be dispensed through orifices in communication with the chambers, by squeezing the tube. In all of these known devices, however, the chambers are made from the same material, usually a polymer of some type.

In dual chamber tubes, the amount of material dispensed from each chamber is dependent upon the decrease in volume of the chamber occasioned by the deformation of the walls of the chamber. This deformation, and thus the amount of material dispensed, depends upon several factors including the viscosities of the substances to be dispensed, the size and shape of the orifices through which the substances are dispensed, the pressure applied to the tube, and the configuration of the tube and chambers.

As previously mentioned, in prior dual chamber tubes, the chambers are formed from a single material. Thus, both chambers will have the same properties relating to flexibility, longevity, and resistance to corrosive products, etc. However, this is not always desirable. Where the two materials to be dispensed have different properties, it may be desirable to vary the properties of the dispensing chambers individually.

As an example, two part tooth-cleansing preparations are becoming increasingly popular. Specifically, such preparations often include an oxidizing agent (such as hydrogen peroxide) and a foaming agent (such as baking soda), including coloring and flavoring agents. In such cases, the choice of a proper material for the packaging can be difficult. A material which acts as an oxygen barrier is desirable for the oxidizing agent, whereas a material with good flavor barrier properties is desirable for the flavored material. However, finding one material with all the desired properties may be difficult or impossible. More likely, it is just expensive.

Further, it may be desirable for the two chambers of a dual chamber dispensing tube to have different flex characteristics due to the properties of the materials being dispensed. If one material has a substantially lower viscosity than the other, the chamber containing the less viscous material should be stiffer. In this manner, more energy is taken up by the chamber and less is transferred to the task of pushing material out of the dispensing tube. In this way, the two material could be dispensed evenly, even though they had differing viscosities.

A dual chamber dispensing tube that facilitates application of proper pressure to both chambers and thereby enables a constant, steady flow of materials from each of the tube chambers is desirable.

SUMMARY OF THE INVENTION

In accordance with this invention, there is provided a container, for dispensing two substances simultaneously, that includes a neck portion having two orifices therein, a shoulder portion connected to the neck portion, and an elongated body portion connected to the shoulder portion, the body portion including two adjacent chambers sharing a common wall wherein each chamber is in fluid communication with an orifice in the neck portion, and wherein the two chambers are formed from different materials. The size and shape of the orifices can be also varied to adjust the rate of dispensation of the substances to aid in compensating for variances in viscosity between the substances.

In the preferred embodiment, the container is a tube made of resilient plastic and has two orifices in the neck portion, the orifices having substantially equal areas. The sizes of the two chambers can be varied independently from one another. Further, the two chambers can extend beyond the width of the common wall, to promote even and predictable deformation of the chambers when pressure is applied.

BRIEF DESCRIPTION OF THE DRAWINGS

FIG. 6 is a cross-sectional view of an extruder and mold for forming the container of the present invention.

FIG. 7 is a cross-sectional view of the extruder and mold shown in FIG. 6, taken along the line 7—7.

FIG. 8 is a cross-sectional view of an alternate embodiment of the present invention.

DETAILED DESCRIPTION OF THE INVENTION

According to the present invention, a dual chamber dispensing container comprises side walls connected to a common inner wall shared by the dual chambers and to the arcuate outer walls of the chambers. The two chambers are formed from two different materials. The container is extrusion blow molded, and, generally any materials suitable for such operations may be used. Specific materials suitable for forming containers according to the present invention include high and low density polyethylene, polypropylene, polyvinyl chloride, ethylene vinyl acetate, polyvinyl alcohol, polystyrene, and polyesters such as PETG (polyethylene terephthalate G), however other suitable extrusion blow moldable materials may also be used.

Figure 1:
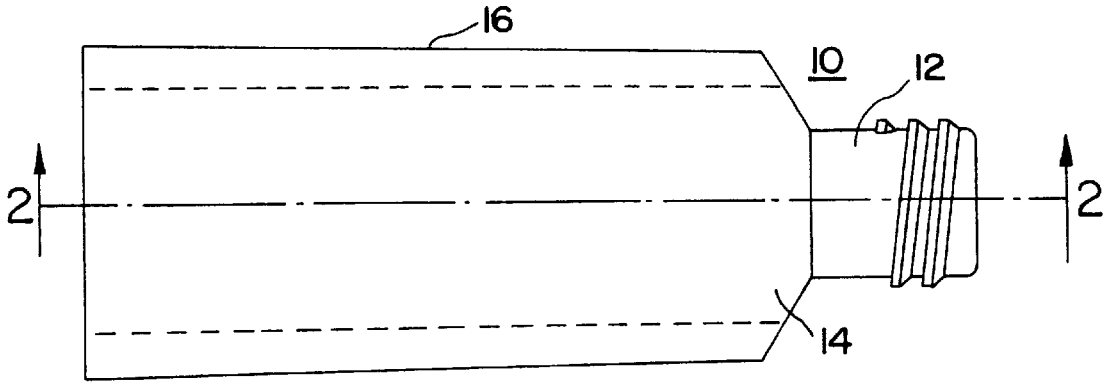
FIG. 1 is a side view of a container of the present invention.
Figure 2:
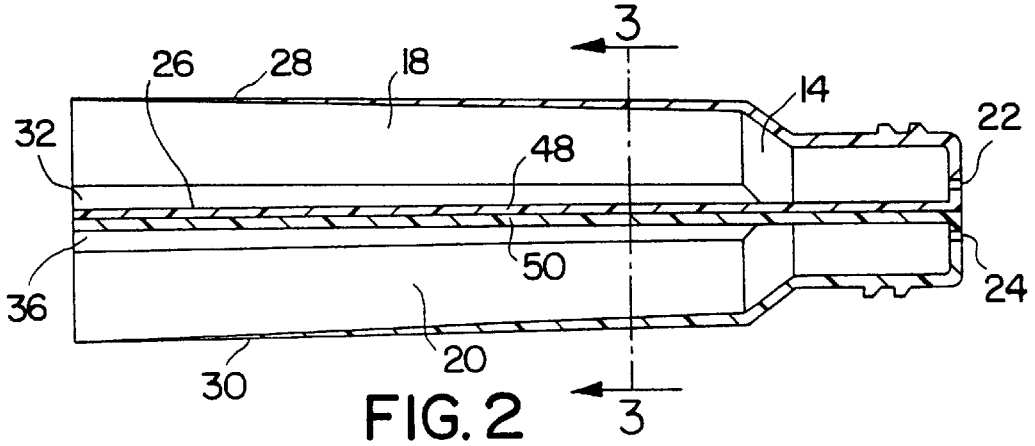
FIG. 2 is a cross-sectional view, in the plane 2—2 of FIG. 1, of the container shown in FIG. 1.
Figure 3:
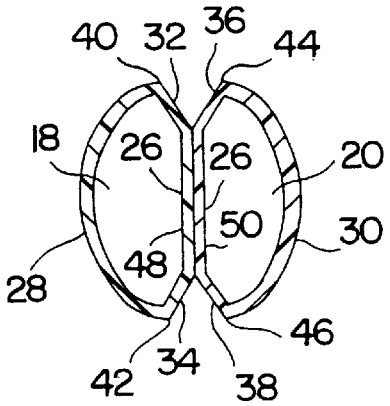
FIG. 3 is a cross-sectional view, in the plane 2—2 of FIG. 2, of the container shown in FIGS. 1 and 2.

The container may have any configuration desired. Several common configurations are shown in FIGS. 1–5 and 8, but any desired configuration may be produced. One such common configuration is shown in FIGS. 1–3, which will now be described. In the configuration shown in FIG. 1, the dual chamber dispensing container 10 is comprised of a neck portion 12, a shoulder portion 14, and an elongated body portion 16. The elongated body portion 16 comprises two chambers 18 and 20, as shown in FIGS. 2 and 3. FIG. 2 shows orifices 22 and 24, which are in fluid communication with chambers 18 and 20, respectively.

As shown in FIG. 3, chambers 18 and 20 are separated by a shared common wall 26. Generally, common wall 26 is not homogenous. Rather common wall 26 comprises two layers 48 and 50. Layer 48 is formed from the same material as chamber 18, while layer 50 is formed from the material used for chamber 20. Thus common wall 26 has barrier properties of both materials. Common wall 26 may also be a mixture of the two materials. Mixing of the two materials can occur as the materials are extruded and subsequently molded. The materials may mix, making common wall 26 more of a mixture than a laminate of two discrete layers.

Chambers 18 and 20 have arcuate outer walls 28 and 30, respectively. Arcuate outer wall 28 of chamber 18 is connected to common wall 26 by side walls 32 and 34. Arcuate outer wall 30 of chamber 20 is connected to the common wall 26 by side walls 36 and 38. The intersections of arcuate wall 28 and side walls 32 and 34 form hinges 40 and 42, respectively.

Similarly, the intersections of arcuate outer wall 30 and side walls 36 and 38 form hinges 44 and 46, respectively. In the preferred embodiments shown in FIGS. 1–5, a chord (not shown) of arcuate outer wall 28 extending between hinges 40 and 42 is greater in length than the width of the common wall. A chord of outer wall 30 extending from hinge 44 to hinge 46 is also greater in length than the width of the common wall. In other embodiments of the present invention (such as that shown in FIG. 8, this will not be the case.

In the preferred embodiment, when chambers 18 and 20 are squeezed toward one another by the application of force to the arcuate outer walls 28 and 30, respectively, hinges 40 and 42, and 44 and 46, flex, and the angle formed by each outer wall and each side wall decreases. AU four hinges flex simultaneously, causing the chambers to act as bellows. As a result of this bellows action, the two chambers 18 and 20 are exposed to substantially equal pressure and steady deformation from the squeezing. This occurs because the four hinges 40, 42, 44 and 46 all flex evenly. A force exerted on arcuate outer walls 28 and 30 for example, causes hinges 44 and 46 and hinges 40 and 42 to flex, thereby pressurizing chambers 18 and 20 and dispensing the two substances disposed therein. Thus, squeezing the tube creates equal pressure in the two chambers.

In addition, as a result of the bellows action, chambers 18 and 20 undergo predictable deformation when constructed of a resilient material. Any conventional resin, used to make flexible containers, may be used to produce the container of the present invention. Upon application of a constant force, predictable chamber deformation occurs. Thus this is the preferred container configuration.

Figure 4:
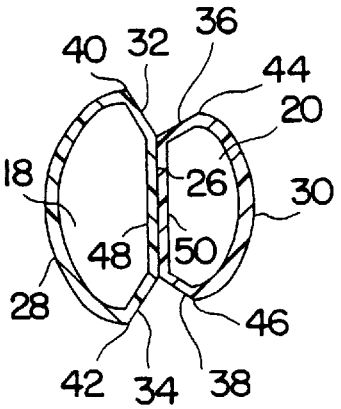
FIG. 4 is a cross-sectional view of an alternate embodiment of the present invention.

FIG. 4 shows an alternative embodiment of the present invention. In this embodiment, the two chambers 18 and 20 have unequal volumes (chamber 18 has a greater volume than chamber 20). Therefore arcuate outer wall 28 which forms part of chamber 18 is longer than arcuate outer wall 30 which forms part of chamber 20. A chord (not shown) of arcuate outer wall 30 (the smaller of the two outer walls) extending between hinges 44 and 46 is greater in length than the width of the common wall 26 which is formed in two layers, 48 and 50. Similarly, a chord of outer wall 28 extending from hinge 40 to hinge 42 is also greater in length than the width of the common wall 26.

Figure 5:
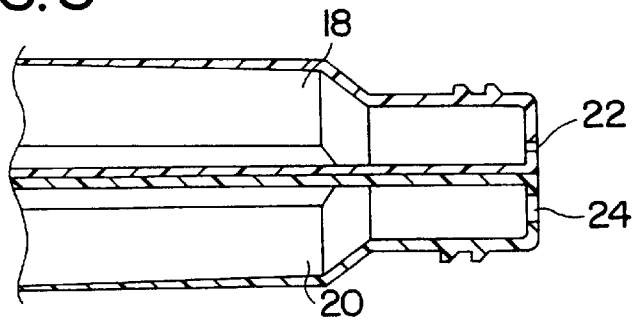
FIG. 5 is a cross-sectional view of an alternate embodiment of the present invention.

The container of the present invention can also be arranged to dispense similar materials in the two chambers in different amounts, in constant predetermined proportions, or to dispense two materials of differing viscosities in the same amounts, when configured as shown in FIG. 5. This can be accomplished by varying the sizes and shapes of orifices 22 and 24. If one orifice 24 is larger than the other orifice 22, the material contained in the chamber communicating with the larger orifice 24 will be dispensed in a greater amount than the same material in the chamber communicating with the smaller orifice 22. Alternatively, a more viscous material in chamber 20 will be dispensed in the same amount as a less viscous material in chamber 18, communicating with smaller orifice 22. Similarly, a round orifice will allow more material to be dispensed than a rectangular orifice having the same cross-sectional area.

Of course, the present invention can also be applied to more traditional dual-chambered dispensing tubes, such as the one shown in FIG. 8. There the tube is an oval in cross section. The tube lacks side walls 32, 34, 36, and 38 as well as hinges 40, 42, 44, and 46. However, common wall 26 still comprises two layers, 48 and 50.

The apparatus for producing containers in accordance with the present invention is shown in FIGS. 6 and 7. FIG. 6 shows a dual extruder 60 having twin extruder screws 62 and 64. The extruder screws 62 and 64 are conventional except that the two screws are joined in one dual extruder as shown in FIG. 6. The extruder 60, using extruder screws 62 and 64 extrudes resin in a traditional manner. The screws 62 and 64 are synchronized to extrude resin at the same time. Each screw extrudes a different resin 66 and 68. The resins 66 and 68 are extruded through extrusion dies 70 and 72 respectively. The resins are extruded into a standard extrusion mold for forming a dual chamber dispensing tube (not shown). The resins are also blown in the standard fashion. No bonding material is required between the two chambers (provided the two resins are compatible) and the resins adhere to one another due to the tackiness of the resins when in a plastic state. For this to be successful, the two resins must be compatible, that is they must be extrudible at comparable temperatures (or the hot resin will remelt the cooler one), and they must be blowable at comparable pressures (or the common wall 26 will be bulged on one direction or the other). The resins must also adhere to one another when hot. Since most resins are tacky when molten, this is usually not a problem.

FIG. 7 shows a cross-section of the dual extruder and extruded and blown bottle of FIG. 6, taken along line 7—7. As may be seen, the die is a typical extruder die, except that there are two such dies located adjacent one another. The mold (and the blowing technique) are also standard for dual chamber dispensing tubes.

While this invention has been described with reference to a specific embodiment, it is not necessarily limited thereto. Accordingly, the appended claims should be construed to encompass not only those forms and embodiments of the invention specifically described above, but to such other forms and embodiments as may be devised by those skilled in the art without departing from its true spirit and scope.

What is claimed:

1. A container for dispensing two substances simultaneously comprising:

a neck portion having a first orifice and a second orifice;

a shoulder portion connected to said neck portion; and a body portion, connected to said shoulder portion, comprising a first chamber having a first volume, and a second chamber having a second volume, said first chamber and said second chamber each in fluid communication with a separate one of said first orifice and said second orifice, respectively said first chamber comprised of a first material, and said second chamber comprised of a second material different than said first material, and said first chamber and said second chamber disposed adjacent to each other.

2. A container as claimed in claim 1 wherein said first orifice and said second orifice have different dimensions.

3. A container as claimed in claim 1 wherein said first volume differs from said second volume.

4. A container as claimed in claim 1 wherein said first orifice and said second orifice have the same dimensions.

5. A container as claimed in claim 1 wherein said first volume is the same as said second volume.

6. A container as claimed in claim 1 wherein said first chamber is comprised of polypropylene and said second chamber is comprised of polyethylene.

7. A container as claimed in claim 1 wherein at least one of said first chamber and said second chamber is formed from a material selected from the group consisting of ethylene vinyl acetate, polyvinyl alcohol, polyethylene, polypropylene, polyvinyl chloride, polystyrene, and polyesters.

8. A container as claimed in claim 7 wherein said material is polyethylene.

9. A container as claimed in claim 7 wherein said material is polypropylene.

10. A container as claimed in claim 1 wherein said first chamber and said second chamber each share a common wall having a width, said common wall comprised of said first material and said second material, and said first chamber and said second chamber each includes an arcuate outer wall having a chord of a length greater than the width of said common wall, said arcuate outer wall connected to said common wall by two side walls which form hinges at the junctures of said arcuate outer wall and said two side walls.

11. A container as claimed in claim 10 wherein said first orifice and said second orifice have different dimensions.

12. A container as claimed in claim 10 wherein said first volume differs from said second volume.

13. A container as claimed in claim 10 wherein said first orifice and said second orifice have the same dimensions.

14. A container as claimed in claim 10 wherein said first volume is the same as said second volume.

15. A container as claimed in claim 10 wherein said first chamber is comprised of polypropylene and said second chamber is comprised of polyethylene.

16. The container of claim 10 wherein said common wall is comprised of a first layer and a second layer, said first layer comprising a part of said first chamber, and said second layer comprising a part of said second chamber.

17. The container of claim 10 wherein said common wall is comprised of a first layer and a second layer, each of said layers extruded together to form said common wall.

18. A container as claimed in claim 10 wherein at least one of said first chamber and said second chamber is formed from a material selected from the group consisting of ethylene vinyl acetate, polyvinyl alcohol, polyethylene, polypropylene, polyvinyl chloride, polystyrene, and polyesters.

19. A container as claimed in claim 18 wherein said material is polypropylene.

20. A container as claimed in claim 18 wherein said material is polyethylene.

* * * * *